US005935918A

United States Patent [19]

Pomp

[11] Patent Number: 5,935,918

[45] Date of Patent: Aug. 10, 1999

[54] FIREARM CLEANING AGENT FOR CLEANING A FIREARM BORE

[76] Inventor: Paul R. Pomp, 5934 E. Sandra Ter., Scottsdale, Ariz. 85254

[21] Appl. No.: 09/036,284

[22] Filed: Mar. 6, 1998

[51] Int. Cl.[6] ..... C11D 7/24; C11D 7/26; C11D 7/50

[52] U.S. Cl. ..... 510/190

[58] Field of Search ..... 510/190

[56] References Cited

U.S. PATENT DOCUMENTS

| | | | |
|---|---|---|---|
| 1,036,383 | 8/1912 | Tromsness | 510/190 |
| 4,315,780 | 2/1982 | Rupp et al. | 134/7 |
| 4,482,469 | 11/1984 | Plötze | 252/155 |
| 4,710,280 | 12/1987 | Brilmyer et al. | 204/146 |
| 4,806,274 | 2/1989 | Crouse et al. | 252/548 |
| 5,603,735 | 2/1997 | Zimin, Sr. et al. | 8/617 |

*Primary Examiner*—John R. Hardee

*Attorney, Agent, or Firm*—Meschkow & Gresham, PLC; Lowell W. Gresham; Jordan M. Meschkow

[57] ABSTRACT

A firearm bore cleaning agent and method are provided for detaching fouling residue from a bore of a firearm. The fouling residue includes carbon and metal residue, such as copper and lead, and the carbon residue acts to bond the metal residue to the bore. The firearm cleaning agent comprises the combination of a hydrocarbon solvent, such as butyl or amyl lactate, and an electrical neutralizing agent, such as hydrocarbon citrus distillate. The hydrocarbon solvent is configured to detach the metal residue from the bore by dissolving the carbon residue and the electrical neutralizing agent is configured to bond with positive ions of the metal residue to prevent the metal residue from rebonding to the bore.

2 Claims, No Drawings

FIREARM CLEANING AGENT FOR CLEANING A FIREARM BORE

TECHNICAL FIELD OF THE INVENTION

The present invention relates in general to cleaning firearms, and in particular, to a firearm cleaning agent and a method for removing fouling residue from the bore of a firearm.

BACKGROUND OF THE INVENTION

When firearms, such as pistols, rifles, and other similar weaponry, are fired, minute amounts of lead, copper, carbon, and other such fouling residue is frequently deposited within the bores and other interior parts of the firearms. Over a period of time, such residue builds up to the extent that the accuracy of the firearm and the integrity of the ferrous metal bore and other interior parts is adversely affected. In addition, a build up of fouling residue poses a significant hazard to a user should the fouling residue cause blockage of, and subsequent explosion within, the bore. Hence, it is necessary to periodically remove the metal and nonmetal fouling residue from the bore of a firearm.

Bore cleaning methods are well established in the prior art and, in general, include various combinations of mechanical abrasion and chemical oxidation or dissolution of the residue. Similar prior art methods and materials have been used both for conventional firearms, like those used for hurting and target shooting, and larger or more sophisticated weapons, such as those used in military or police applications. Unfortunately, the conventional bore cleaning process is characterized by tedious and time-consuming work. In addition, many of the cleaning solvents pose significant health hazards due to their volatility and/or toxicity.

Metal residue is the most difficult of the fouling residues to remove from the bore of a firearm. Metal residue may include layers of lead or lead alloy from firing lead or partially-jacketed bullets; and/or copper, gliding metal or other copper alloy metals from jacketed bullets. The layers of metal residue are most commonly removed by wetting the interior of the bore with a solvent or penetrant which dissolves or loosens the metal residue. Various types of brushes are frequently used to aid loosening. The residue is then removed from the bore with a cloth patch or a cleaning rod. For harder or thicker metal layers, abrasive cleaners applied with a patch or metal-bristled brush, with or without solvents, are often used. Unfortunately, the cleaners, solvents, and brushes can undesirably pit or otherwise damage the ferrous metal bore.

A prior art method used to remove lead deposits involves treating the bore with mercury to form a lead-mercury amalgam which loosens and/or dissolves the lead from the bore for relatively easy removal. However, the high toxicity and hazards related to the handling and use of mercury are well known and this method is, therefore, extremely unsafe, regardless of its efficacy.

Copper and copper alloy residues pose a particularly difficult cleaning problem due to the relatively strong electropositive nature of copper. A conventional method for removing copper or copper alloy deposits is to plug and fill the bore with an aqueous ammonia solution. The firearm, filled with the aqueous ammonia solution, is allowed to stand for several hours until the copper residue is chemically oxidized and dissolved. The bore is then brushed and swabbed as previously discussed. However, the ammonia concentration in some formulations is sufficiently high that contact with the eyes is dangerous and the evolution of noxious fumes can lead to respiratory injuries. In addition, conventional methods that employ ammonia derivatives, such as methylamine, or ammonia-based solutions such as ammonium persulfate, ammonium sulfate, and so forth, pose similar hazards and do little to alleviate the tedious and time-consuming process of cleaning the bore of a firearm.

Repeated cleaning of firearms by the foregoing methods, particularly those using abrasive brushing, measurably wear the ferrous bore surface, adversely affect performance and accuracy, and result in shorter useful life.

As an alternative to the previously discussed methods, some prior art methods have suggested the use of electrolysis to remove copper residue from the bore of a firearm. One such method involves an electrolytic bath consisting of sodium nitrate and chromic acid and the passage of an electric current through the electrolytic solution. The effect of such treatment is the migration of the negatively and positively charged ions, such as metal ions, to the positive and negative electrodes, respectively. Unfortunately, this electrolyte is highly oxidizing to iron and, at the current densities applied, results in unacceptable corrosion of the ferrous metal bore of the firearm.

A similar electrolytic stripping process for removing copper, nickel, or chromium coatings is a bath consisting of sodium nitrate and an alkali metal hydroxide to which sodium nitrite is added to prevent etching of the ferrous metal bore. However, this electrolytic solution is also highly oxidizing. In addition, the process operates at relatively high current densities and temperatures and requires the use of chemicals which pose substantial health hazards.

The cleaning methods that employ electrolysis necessitate the use of electrically powered equipment that may be inconvenient or pose an unacceptable cost to a user cleaning only one or a small number of firearms. In the case of military weaponry, the electrolytic bath and associated equipment is impractical and expensive for use in the field.

SUMMARY OF THE INVENTION

Accordingly, it is an advantage of the present invention that a firearm cleaning agent and method are provided for cleaning the bore of a firearm.

Another advantage of the present invention is that a firearm cleaning agent and method are provided that effectively remove metal fouling, including copper, from the bore of the firearm.

Another advantage of the present invention is that a firearm cleaning agent and method are provided that are nonhazardous to the user and the environment.

Another advantage of the present invention is that a firearm cleaning agent and method are provided that are nonharmful to the precision surfaces of the firearm.

Yet another advantage of the present invention is that a firearm cleaning agent and method are provided that reduce the amount of equipment needed to clean the bore of the firearm.

The above and other advantages of the present invention are carried out in one form by a firearm cleaning agent for detaching fouling residue, including carbon and metal, from a bore of a firearm. The firearm cleaning agent includes a solvent configured to detach the metal residue from the bore by dissolving the carbon residue, where the carbon residue is acting to bond the metal residue to the bore. The firearm cleaning agent also includes an electrical neutralizing agent configured to bond with the positive ions of the metal residue.

The above and other advantages of the present invention are carried out in another form by a firearm bore cleaning method for removing fouling residue from a bore of a firearm, the fouling residue including carbon and metal. The method calls for dissolving the carbon residue to detach the metal residue from the bore, the carbon residue acting to bond the metal residue to the bore. The method further calls for neutralizing positive metal ions in the metal residue and wiping the bore to remove the fouling residue.

DETAILED DESCRIPTION OF THE PREFERRED EMBODIMENTS

The present invention comprises a liquid composition having a solvent and an electrical neutralizing agent for detaching fouling residue from the bore of a firearm, such as pistols, rifles, smooth bore black powder rifles, military weaponry, and so forth. The fouling residue includes carbon and metals, such as copper and lead.

The solvent of the composition is an ester of natural lactic acid and an alcohol, and is selected from a lactate group of butyl lactate and amyl lactate, for example. A lactate ester is produced from renewable resources, i.e., sugar, and is essentially one hundred percent biodegradable and low in toxicity.

The solvent is characterized by a kauri-butanol value of at least five hundred and preferably greater than one thousand. The kauri-butanol value is a term applied to solvents to indicate their dissolving powers for resins, hence, the kauri-butanol value indicates the efficiency of the hydrocarbon solvent to dissolve carbon, such as the carbon fouling in the bore of a firearm.

The solvent is further characterized by a relative evaporation rate. The relative evaporation rate is the rate at which the liquid solvent evaporates, or vaporizes. An adequate evaporation rate is desirable to ensure that the solvent remains in solution long enough to dissolve the carbon residue, yet not so long that the precision surfaces of the bore are damaged by the solvent. Accordingly, the relative evaporation rate for the solvent is in a range of 0.01 to 0.1, and is based on a scale where an evaporation rate of n-butyl acetate is one.

The solvent is also characterized by a flash point. The flash point is the lowest temperature at which a liquid in a specified apparatus will give off sufficient vapor to ignite momentarily on application of a flame. Consequently, it is desirable that the solvent has a high flash point in order to decrease the possibility of ignition. Thus, the flash point for the solvent is greater than 150° F. (ASTM D-3278, Seta Flash Closed Tester method B).

The preferred solvent is PURASOLV® butyl lactate supplied by PURAC America, Inc., 111 Barclay Boulevard, Lincolnshire, Ill. 60069. Butyl lactate is characterized by a kauri-butanol value greater than one thousand, a relative evaporation rate of 0.035 (n-BuAc=1), and a flash point of 171° F. Butyl lactate is selected because of it's high solvency power, toxicological safety, and biodegradability. Butyl lactate is Food and Drug Administration (FDA) approved as a flavor additive in foods. Amyl lactate has a higher kauri-butanol value than butyl lactate, and is also acceptable. Of course, those skilled in the art will recognize that a combination of butyl lactate and amyl lactate nay also yield an acceptable solvent.

The electrical neutralizing agent of the composition is a hydrocarbon citrus distillate characterized by an electrical conductivity less than one millionth of a mho, and preferably less than $10^{-10}$ mho. The hydrocarbon citrus distillate is configured to bond to positive metal ions, and due to the low conductivity of the electrical neutralizing agent, cause the positive metal ions to become less electropositive. Once the positive ions become less electropositive, the fouling residue is less able to rebond to the bore of the firearm.

The preferred hydrocarbon citrus distillate is ELECTRON Dielectric Solvent supplied by ECOLINK, INC., 1481 Rock Mountain Blvd., Stone Mountain, Ga. 30083. The components of ELECTRON Dielectric Solvent include Citrus Terpenes and Severely Hydrotreated Light Distillate. ELECTRON Dielectric Solvent is characterized by a conductivity of approximately $76(10^{-12})$ of a mho. It is selected for it's low conductivity, toxicological safety, biodegradability, and mild citrus terpene odor.

Through trial and error, it was discovered that a liquid composition consisting essentially of greater than twenty weight percent of hydrocarbon citrus distillate and less than eighty weight percent of lactate produces a composition having good to excellent bore cleaning properties, as well as being environmentally and toxicologically safe. This invention will be better understood by reference to the following example, which is included here for the purpose of illustration and is not to be construed as a limitation.

EXAMPLE 1

A firearm cleaning solution is manufactured by mixing approximately twenty-five weight percent of ELECTRON Dielectric Solvent into approximately seventy-five weight percent of PURASOLV® butyl lactate.

The firearm cleaning agent useable in a firearm bore cleaning method for removing fouling residue is applied to the bore of the firearm by coating the bore with a patch soaked with the composition described in EXAMPLE 1. The firearm cleaning agent is allowed to remain on the bore for 2–5 minutes to allow the firearm cleaning agent to perform.

The lactate component (PURASOLV® butyl lactate) of the firearm bore cleaning agent first dissolves the carbon residue that builds up from gunpowder or firing charge. This carbon residue acts to bond metal residue, such as copper and lead, to the bore of the firearm. In addition, copper and lead are bonded together by the carbon residue in layers on the surface of the bore. Hence, the lactate component dissolves the carbon residue between the metal residue and the bore, as well as between the layers of the metal residue in order to detach the metal residue from the bore of the firearm.

As the lactate penetrates and dissolves the carbon residue, the lactate carries the hydrocarbon citrus distillate component (ELECTRON Dielectric Solvent) of the composithon to the metal residue. It is desirable that the hydrocarbon citrus distillate has a slower evaporation rate than the lactate so that the hydrocarbon citrus distillate does not evaporate before the lactate can carry it to the metal residue.

The hydrocarbon citrus distillate serves to neutralize the positive metal ions, such as copper and lead ions. Neutralization is accomplished by ionic bonding between the substantially nonconductive hydrocarbons of the hydrocarbon citrus distillate to the positive copper and lead ions to cause the metal residue to become less electropositive. Changing the electrical characteristics of the metal residue prevents the metal residue from rebonding to the bore of the firearm.

Following dissolution of the carbon residue and electrical neutralization of the metal residue, the loosened fouling residue is removed by wiping the bore. The bonre is preferably wiped with a non-metallic abrasive pad. Alternatively, a standard bore brush may be used.

In summary, a firearm cleaning agent and method are provided for cleaning the bore of a firearm. The firearm cleaning agent and method effectively remove metal residues, including copper, by dissolution of the carbon residue and the electrical neutralization of the metal ions in the metal residue. The use of a composition of lactate and hydrocarbon citrus distillate results in a firearm cleaning agent that is toxicologically safe, biodegradable, and non-hazardous to the environment. In addition, the combined action of the lactate and hydrocarbon citrus distillate causes the fouling residue to detach from the bore for easy removal so that the precision surfaces of the firearm are not harmed. Additionally, the firearm cleaning agent does not necessitate the use of additional equipment, making it less cumbersome and less costly to use in field applications.

Although the preferred embodiments of the invention have been illustrated and described in detail, it will be readily apparent to those skilled in the art that various modifications may be made therein without departing from the spirit of the invention or from the scope of the appended claims. For example, an alternate solvent which exhibits a sufficient kauri-butanol value and/or an electrical neutralizing agent having sufficiently low conductivity, which are further distinguished by toxicological safety, biodegradability, and environmental safety, may be selected.

What is claimed is:

1. A firearm cleaning agent for detaching fouling residue from a bore of a firearm, said fouling residue comprising carbon and metals, including copper, and said firearm cleaning agent consisting essentially of:

approximately seventy-five weight percent of a lactate characterized by a kauri-butanol value of greater than one thousand, said lactate being configured to detach said metal residue from said bore by dissolving said carbon residue, said carbon residue acting to bond said metal residue to said bore; and approximately twenty-five weight percent of a hydrocarbon citrus distillate having an electrical conductivity of approximately $76(10^{-12})$ of a mho, said hydrocarbon citrus distillate being configured to cause positive metal ions of said metal residue to become less electropositive in order to prevent said metal residue from reattaching to said bore.

2. A firearm cleaning agent as claimed in claim 1, wherein said metal residue includes lead, and said copper and lead are bonded together by said carbon residue in layers on a surface of said bore, and said lactate dissolves said carbon residue between said layers.

* * * * *